United States Patent [19]

Leonard

[11] 4,136,513

[45] Jan. 30, 1979

[54] ERROR COMPENSATOR FOR A TIMEPIECE

[76] Inventor: Vivian A. Leonard, 1200 Cordell St., Denton, Tex. 76201

[21] Appl. No.: 733,299

[22] Filed: Oct. 18, 1976

[51] Int. Cl.[2] ..... G04C 13/08; G04C 9/00; G04B 27/00

[52] U.S. Cl. ..... 58/34; 58/26 R; 58/85.5

[58] Field of Search ..... 58/26 R, 34, 35 W, 36, 58/37, 63, 64, 85.5, 46 R, 46 A, 48, 41; 73/6

[56] References Cited

U.S. PATENT DOCUMENTS

| | | | |
|---|---|---|---|
| 1,672,802 | 6/1928 | Chirol | 58/34 |
| 1,961,320 | 6/1934 | Worrall | 58/34 |
| 2,658,329 | 11/1953 | Nelson | 58/34 X |
| 2,889,680 | 6/1959 | Dicke | 58/34 |
| 3,039,261 | 6/1962 | Dicke | 58/35 R |
| 3,282,043 | 11/1966 | Duris | 58/34 |
| 3,563,025 | 2/1971 | Kulick | 58/35 R |
| 3,678,307 | 7/1972 | Clifford | 310/22 |
| 4,023,344 | 5/1977 | Mukaiyama | 58/35 W |

*Primary Examiner*—Edith S. Jackmon
*Attorney, Agent, or Firm*—Richards, Harris & Medlock

[57] ABSTRACT

A compensator for correcting any time gain or loss in the minute and hour hand works in a time-keeping mechanism, wherein signals are received and converted into first and second electrical signals at predetermined time intervals, includes a servo unit for receiving the electrical signals. Upon receiving the first signal, the servo unit drives a first lever to contact and drive a first pin to a first position, and upon receiving the second signal, the servo unit drives a second lever to contact and drive a second pin to a second position. A first clutch is fixed to the first pin and is adapted to uncouple the minute and hour hand works from the mainspring assembly when the first pin is driven to the first position and to drive the minute and hour hand works to a first time setting. A second clutch is fixed to the second pin and is adapted to drive the minute and hour hand works to a second time setting when the second pin is driven to the second position and thereupon to couple the minute and hour hand works to the mainspring assembly.

10 Claims, 6 Drawing Figures

ERROR COMPENSATOR FOR A TIMEPIECE

BACKGROUND OF THE INVENTION

This invention relates to a compensator and, more particularly, to a compensator for a conventional time-keeping mechanism.

Watches, clocks and other time-keeping mechanisms, regardless of their design and construction, are subject to deviation and inaccuracy. Even if the time deviation is small, it is accumulative and necessitates periodic resetting of the time-keeping mechanism. Continual research in the horology industry is constantly performed to discover more accurate means of recording time. Current attempts in exploiting the use of the reed, tuning fork, quartz crystal, electrical and electronic components have resulted in extremely accurate time-keeping mechanisms, but are generally beyond the convenient reach of the general population in terms of economic cost.

Moreover, attempts have been made in recent years to develop inexpensive compensators, but these compensators often require the use of external or additional power sources as well as an electrical circuit for the compensator itself. Also, there are known regulating mechanisms which must be actuated by manual resetting of the watch or clock hands, thus increasing or decreasing the torque of the mainspring.

The present invention solves the need for a simple, inexpensive compensator for time-keeping mechanisms. The compensator automatically regulates the time-keeping mechanism to correct any time gain or loss in the minute and hour hand works. The compensator finds usage in any expensive or inexpensive type of watch, clock, chronometer, or other time-keeping mechanism and operates independently of any manipulation by the user. Manual resetting of the time-keeping mechanism is still possible even though the time-keeping mechanism includes the compensator as herein provided. Further, the compensator utilizes the existing energy source in the time-keeping mechanism whether the time-keeping mechanism is powered or operated by such energy sources as a spring, battery, tuning fork, body movement, or the like. Twin-adjustment compensation for either loss or gain of time in the time-keeping mechanism is provided and the compensator may be set by the manufacturer to automatically regulate the time-keeping mechanism at any time interval desired, such as hourly, every twelve hours, daily, or weekly. Finally, the compensator may be manufactured and assembled with low economic cost to the manufacturer.

SUMMARY OF THE INVENTION

According to the present invention, a compensator for correcting any time loss or gain in minute and hour hand works in a time-keeping mechanism, wherein signals are received and converted into first and second electrical signals at pre-determined intervals, includes a servo unit for receiving the electrical signals. Upon receiving the first signal, the servo unit drives a first lever to contact and drive a first pin to a first position. Upon receiving the second signal, the servo unit drives a second lever to contact and drive a second pin to a second position. A first clutch is fixed to the first pin and is adapted to uncouple the minute and hour hand works from a mainspring assembly when the first pin is driven to the first position and to drive the minute and hour hand works to a first time setting. A second clutch is fixed to the second pin and is adapted to drive the minute and hour hand works to a second time setting when the second pin is driven to the second position and thereupon to couple the minute and hour hand works to the mainspring assembly.

DETAILED DESCRIPTION OF THE DRAWINGS

DETAILED DESCRIPTION OF THE INVENTION

Figure 1:
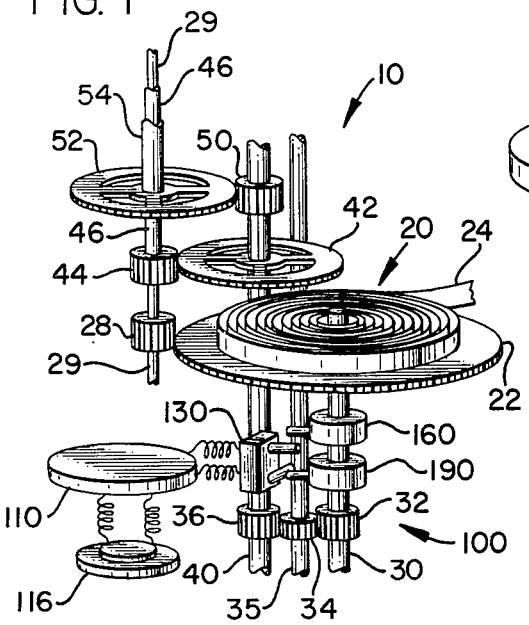
FIG. 1 is a perspective view of the compensator situated within a conventional time-keeping mechanism powered by spring energy.

Referring now to FIG. 1, a time-keeping mechanism is generally described as reference numeral 10. Mechanism 10 may be any watch, clock, chronometer, or other time-keeping or timing mechanism. In this particular embodiment, mechanism 10 is powered by spring energy, but the present invention is operational within any time-keeping mechanism whether powered by battery, tuning fork, body movement, or similar energy source.

Figure 3:
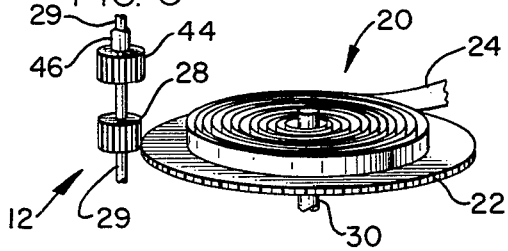
FIG. 3 is a fragmentary view of the mainspring assembly and the seconds hand works.
Figure 4:
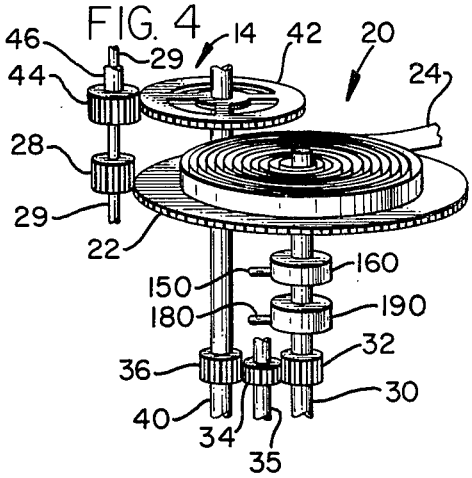
FIG. 4 is a fragmentary view of the mainspring assembly and the minute hand works.
Figure 5:
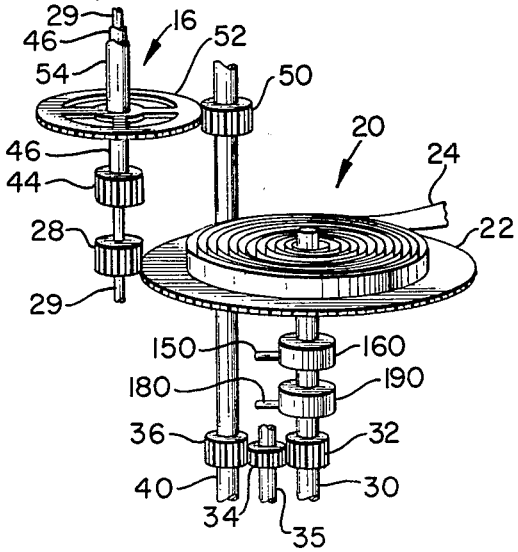
FIG. 5 is a fragmentary view of the mainspring assembly and the hour hand works.

Now referring to FIGS. 3, 4, and 5, mechanism 10 comprises elements found in any conventional time-keeping mechanism. In this particular embodiment, mechanism 10 includes seconds hand works 12, minute hand works 14, and hour hand works 16. As used herein, the minute hand works 14 and the hour hand works 16 may be collectively referred to as the "minute and hour hand works". More particularly, mechanism 10 has a mainspring assembly 20 having a seconds wheel 22, a mainspring shaft 30 integrally attached to the center of seconds wheel 22, and a mainspring 24 having one end attached to a first end of shaft 30 and the other end attached to the casing (not shown). Rigidly mounted over shaft 30 and below seconds wheel 22 is a mainspring gear 32 operably connected to gear 36 by means of reversing gear 34 on shaft 35. Gear 36 is rigidly mounted for rotation with shaft 40 which accommodates minute wheel 42 having teeth engaged in minute gear 44 fixed to minute shaft 46 operating the minute hands (not shown). Shaft 40 also has fixed thereto an hour gear 50 meshing with hour wheel 52 fixed for rotation with hour shaft 54 operating the hour hand (not shown). Finally, seconds wheel 22 meshes with seconds gear 28 mounted over seconds shaft 29 operating the seconds hand (not shown).

Figure 2:
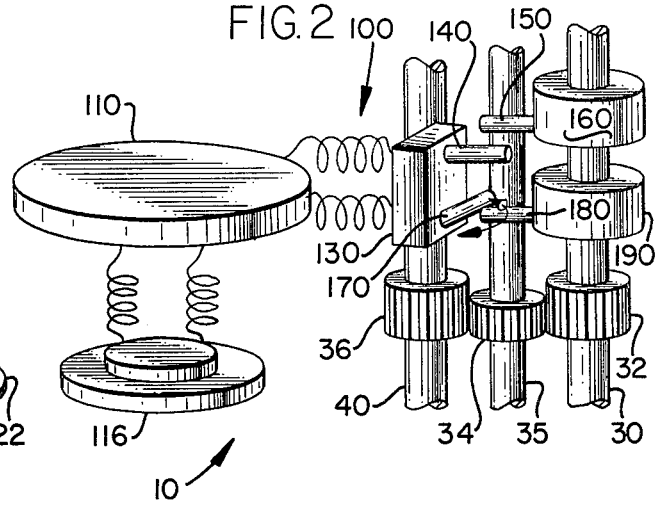
FIG. 2 is an enlarged, perspective view of the compensator.

As shown in FIG. 2, mechanism 10 further includes compensator 100 comprising the present invention. Compensator 100 automatically regulates mechanism 10 at any time interval desired to correct any time gain or loss in the minute and hour hand works, and operates independently of any manual manipulation by the user while permitting manual resetting of mechanism 10 except for short periods of time. Compensator 100 also utilizes the existing energy source in mechanism 10, and includes simple elements thus enabling assembly of compensator 100 at low economic cost.

Referring now to FIGS. 1 and 2, in the preferred embodiment, compensator 100 includes receiving and converting means 110 which is designed to receive and convert time signals emitted from a standard time source (not shown) into first and second electrical signals at pre-determined time intervals. Receiving and converting means 110 is energized by a standard energy source such as mercury source 116. Receiving and converting means 110 may be any type of unit known to one skilled in this art having the functions of receiving time signals emitted from a standard time source and converting the time signals into first and second electrical signals at pre-determined time intervals.

Time signals, in the form of audio pulses, are generated and broadcast from numerous stations located throughout the world. For example, an audio pulse (5 cycles of 1000 Hz) is generated and broadcast from WMV station located at Fort Collins, Col., and occurs each second of the minute except from the 29th and 59th seconds which are omitted completely. At the beginning of each minute, a long pulse of approximately 0.8 seconds of 1500 Hz marks each hour.

Receiving and converting means 110 is designed to receive such time signals and upon receiving the time signals, receiving and converting means 110 is designed to convert the time signals into electrical signals at pre-determined time intervals. For instance, the manufacturer of compensator 100 may calibrate the receiving and converting means 110 to generate a first electrical signal at 11:55 p.m. Thereafter, a second electrical signal may be generated at 12:00 a.m. It is stressed that receiving and converting means 110 may be calibrated to generate the electrical signals at any time, such as hourly, every twelve hours, daily, weekly, or monthly, and the time interval between the generation of the first and second electrical signals is also discretionary with the manufacturer.

As more fully described hereinafter, when the first electrical signal is generated, the compensator will uncouple the minute and hour hand works from the mainspring apparatus and when the second electrical signal is generated, the compensator will couple the minute and hour hand works to the mainspring apparatus. During the time interval when the compensator uncouples the minute and hour hand works from the mainspring apparatus, the compensator will correct any time gain or loss that the minute and hour hand works may have accumulated. Thus, it is seen that compensator 100 has been designed to automatically regulate mechanism 10 at various time intervals, depending upon how the receiving and converting means 110 is calibrated.

Figure 6:
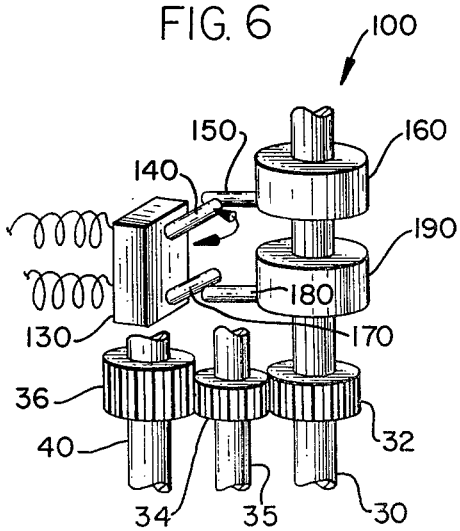
FIG. 6 is an enlarged, fragmentary, perspective view of the compensator.

Compensator 100 further includes servo unit 130 having the capability of receiving electrical signals generated by receiving and converting means 110. Upon receiving the first signal, servo unit 130 drives a first lever 140 through an arc or in a straight line, thereby contacting a first pin 150. First lever 140 may be any type of lever means which will operate upon activation through an arc or in a straight line and will return to its original position for another sequence at a later time. In this particular embodiment, first lever 140 is spring biased toward the position seen in FIG. 2. As seen in FIG. 6, first lever 140 has moved through an arc and occupies an alternative position relative to its normal position. After causing first lever 140 to move to the alternative position, servo unit 130 is designed to release first lever 140 which returns to its normal position as seen in FIG. 2.

When servo unit 130 drives first lever 140 through the arc, first lever 140 contacts and drives a first pin 150 to a first position. When first lever 140 is designed to move through an arc, thereby contacting and driving first pin 150 to the first position, first lever 140 should be set to move through a pre-determined arc, thereby always moving first pin 150 to the first position and thereafter not contacting first pin 150. When first pin 150 is at the first position, the minute and hour hand works, operably connected to first pin 150, are powered to a first time setting. In the preferred embodiment, first time setting is five minutes past the hour, and in the most preferred embodiment, first time designation is 12:05 a.m.

Fixed to a first pin 150 is first clutch 160 which is also rotatively connected to mainspring shaft 30 of mechanism 10. Clutch 160 functions to uncouple the minute and hour hand works from mainspring assembly 20 and drives the minute and hour hand works to the first time setting. First clutch 160 may be any known type of clutch means which is rotatively connected to mainspring shaft 30 and uncouples elements on one end of the shaft from elements on the opposite end of the shaft. For example, first clutch 160 may be composed of two slip plates having opposed dogs. If first pin 150 is fixed to a lower slip plate mounted on the shaft operably engaged with the minute and hour hand works, driving of first pin 150 by first lever 140 to the first position will cause the lower slip plate to rotate ahead of the upper slip plate and concurrently cause the minute and hour hand works to rotate forward. The minute and hour hand works will rotate to the first time setting and will remain in that position until driven in a reverse direction by the action of the second clutch. It should be noted that the minute and hour hand works may not be manually set before the minute and hour hand works are powered in a reverse direction by the action of the second clutch.

Upon receiving the second signal, servo unit 130 drives a second lever 170 through an arc or in a straight line thereby contacting second pin 180. Again, second lever 170 may be any type of lever means which will operate upon activation through an arc or in a straight line and will return to its original position for another sequence at a later time. In this particular embodiment, second lever 170 is spring biased toward the position seen in FIG. 2. Second lever 170 may also move through an arc and occupy an alternative position relative to its normal position. After causing second lever 170 to move to the alternative position, servo unit 130 is designed to release second lever 170, and second lever 170 returns to its normal position as seen in FIG. 2.

When servo unit 130 drives second lever 170 through the arc, second lever 170 contacts and drives a second pin 180 to a second position. In the preferred embodiment, second lever 170 should be set to drive second pin 180 to the second position and therafter not contact second pin 180. When second pin 180 is in the second position, the minute and hour hand works, operably connected to second pin 180, are powered to a second time setting. It should be recognized that when the minute and hour hand works move to the second time setting, they are powered in the reverse direction of that when first lever 140 drives first pin 150 to the first position. In the preferred embodiment, second time setting is on the hour, and in the most preferred embodiment, second time setting is 12:00 a.m.

Fixed to second pin 180 is second clutch 190 which is rotatively connected to minute and wheel hand works. When second lever 170 contacts and drives second pin 180 to the second position, second clutch 190 drives the minute and hour hand works to a second time setting. At this point, the minute and hour hand works couple with the mainspring assembly 20 and, once again, are operated by mainspring assembly 20.

Compensator 100 may be calibrated to operate in the following manner. At 11:55 p.m., receiving and converting means 110 receives an audio pulse and produces a first electrical signal which is received by servo unit 130. When servo unit 130 drives first lever 140 through an arc thereby contacting and driving first pin 150 to the first position, first clutch 160 will uncouple the minute and hour hand works from mainspring assembly 20. First clutch 160 further drives minute and hour hand works to a first time setting where mechanism 10 indicates the time as 12:05 a.m. At this point, the minute and hour hand works are not affected by the continuing operation of the mainspring assembly 20 as it continues to operate the seconds hand works. When the audio pulse is generated for signalling 12:00 a.m., receiving and converting means 110 produces the second electrical signal which is received by servo unit 130. Upon receiving the second signal, servo unit 130 drives second lever 170 through an arc thereby contacting and driving second pin 180 to the second position, and concurrently the minute and hour hand works are driven to the second time setting, 12:00 a.m. Now, second clutch 190 couples the minute and hour hand works to mainspring assembly 20 which thereafter powers the minute and hour hand works until the next regulating sequence occurs. Thus, it can be seen that any time loss or gain in the minute or hour hand works is corrected by the self-actuating compensator.

Compensator 100 may be set to automatically correct mechanism 10 at pre-determined time intervals such as hourly, every twelve hours, daily, weekly or any other desired time interval. If compensator 100 is calibrated to automatically regulate mechanism 10 at 12:00 a.m. each day, it is likely that the regulating sequence will occur without notice of the user, since one is normally asleep at that time.

Thus it is apparent that there has been provided, in accordance with the invention, a compensator that fully satisfies the aims as set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A compensator for correcting time loss or gain in minute and hour hand works in a time-keeping mechanism wherein signals are received and converted into first and second electrical signals at predetermined time intervals, comprising:

(a) a servo unit for receiving the electrical signals, and upon receiving the first signal, the servo unit driving a first lever to contact and drive a first pin to a first position, and upon receiving a second signal, the servo unit driving a second lever to contact and drive a second pin to a second position;

(b) a first clutch fixed to the first pin, rotatively coupled to a main drive shaft of a main drive assembly, and drivably connected to minute and hour hand works, the first clutch adapted to uncouple the minute and hour hand works from the main drive assembly when the first pin is driven to the first position, the first clutch further adapted to drive the minute and hour hand works to a first time setting; and (c) a second clutch fixed to the second pin, rotatively coupled to the main drive shaft of the main drive assembly, and drivably connected to the minute and hour hand works, the second clutch adapted to drive the minute and hour hand works to a second time setting when the second pin is driven to the second position and thereupon to couple the minute and hour hand works to the main drive assembly.

2. The compensator of claim 1 wherein the first clutch uncouples the minute and hour hand works from the main drive assembly at five minutes before an hour and the second clutch couples the minute and hour hand works to the main drive assembly on the hours.

3. The compensator of claim 1 wherein the first clutch uncouples the minute and hour hand works from the main drive assembly at 11:55 p.m. and the second clutch couples the minute and hour hand works to the main drive assembly at 12:00 a.m.

4. The compensator of claim 1 wherein the first and second levers are biased members and are driven by the servo unit through pre-determined arcs to contact and drive the first and second pins to first and second positions, respectively.

5. The compensator of claim 1 wherein each of the first and second clutches are comprised of two slip plates having opposed dogs.

6. The compensator for correcting time gain of loss in minute and hour hand works in a time-keeping mechanism, comprising:

(a) means for receiving and converting time signals emitted from a standard time source into first and second electrical signals at predetermined time intervals;

(b) a servo unit for receiving the electrical signals converted by the receiving and converting means, and upon receiving the first signal, the servo unit driving, in a clockwise direction, a biased first lever through a predetermined arc thereby contacting and driving a first pin to a first position, and upon receiving a second signal, the servo unit driving, in a counterclockwise direction, a biased second lever through a predetermined arc thereby contacting and driving a second pin to a second position;

(c) a first clutch fixed to the first pin, rotatively coupled to a main drive shaft of a main drive assembly, and drivably connected through a gear arrangement to minute and hour hand works, the first clutch adapted to uncouple the minute and hour hand works from the main drive assembly when the first pin is driven to the first position, the first clutch further adapted to drive the minute and hour hand works in a clockwise direction to a first time setting; and (d) a second clutch fixed to the second pin, rotatively coupled to the main drive shaft of the main drive assembly, and drivably connected through the gear arrangement to the minute and hour hand works, the second clutch adapted to drive the minute and hour hand works in a counterclockwise direction to a second time setting when the second pin is driven to the second position and thereupon to couple the minute and hour hand works to the main drive assembly.

7. The compensator of claim 6 wherein the first clutch uncouples the minute and hour hand works from the main drive assembly at five minutes before an hour and the second clutch couples the minute and hour hand works to the main drive assembly on the hour.

8. The compensator of claim 6 wherein the first clutch uncouples the minute and hour hand works from the main drive assembly at 11:55 p.m. and the second clutch couples the minute and hour hand works to the main drive assembly at 12:00 a.m.

9. The compensator of Claim 6 wherein each of the first and second clutches are comprised of two slip plates having opposed dogs.

10. A compensator for correcting time loss or gain in minute and hour hand works in a time-keeping mechanism where signals are received and converted into first and second electrical signals at predetermined time intervals, comprising:

a servo unit for receiving the electrical signals and upon receiving the first signal, the servo unit driving a first lever to drive a first shaft to a first position, and upon receiving a second signal, the servo unit driving a second lever to drive the first shaft to a second position, and a clutch fixed to the first shaft, rotatably couples to a main drive shaft of a main drive assembly, and drivably connected to minute and hour hand works, the clutch adapted to uncouple the minute and hour hand works from the main drive assembly when the first shaft is driven to the first position, and further adapted to uncouple the minute and hour hand works from the main drive assembly when the first shaft is driven to the second position thereby driving the minute and hour hand works to a preselected time setting.

* * * * *